United States Patent [19]

Regan et al.

[11] 4,339,690

[45] Jul. 13, 1982

[54] ENERGY SAVING FLUORESCENT LIGHTING SYSTEM

[75] Inventors: Robert J. Regan, Needham; Adrian Cogan, Waltham; Carl F. Buhrer, Framingham, all of Mass.

[73] Assignee: GTE Laboratories Incorporated, Waltham, Mass.

[21] Appl. No.: 174,472

[22] Filed: Aug. 1, 1980

[51] Int. Cl.[3] ..... H05B 41/14

[52] U.S. Cl. ..... 315/97; 315/101; 315/106; 315/189; 315/228; 315/240; 315/DIG. 5

[58] Field of Search ..... 315/58, 71, 96, 97, 315/99, 180, 187, 189, 228, 250, 324, DIG. 5, 101, 105, 106, 107, 240

[56] References Cited

U.S. PATENT DOCUMENTS

| | | | |
|---|---|---|---|
| 3,372,300 | 3/1968 | Furui | 315/96 |
| 3,716,751 | 2/1973 | Takei et al. | 315/101 X |
| 3,851,209 | 11/1974 | Murakami et al. | 315/DIG. 5 |
| 3,954,316 | 5/1976 | Luchetta | 315/228 X |
| 3,956,665 | 5/1976 | Westphal | 315/187 X |
| 3,997,814 | 12/1976 | Toho | 315/DIG. 5 |
| 4,015,167 | 3/1977 | Samuels | 315/99 |
| 4,082,981 | 4/1978 | Morton et al. | 315/97 |
| 4,135,115 | 1/1979 | Abernethy et al. | 315/324 X |
| 4,146,820 | 3/1979 | Bessone et al. | 315/227 R |
| 4,163,176 | 7/1979 | Cohen et al. | 315/58 X |
| 4,204,139 | 5/1980 | Shimer et al. | 315/58 X |
| 4,227,118 | 10/1980 | Britton | 315/105 X |

*Primary Examiner*—Eugene La Roche
*Attorney, Agent, or Firm*—J. Stephen Yeo

[57] ABSTRACT

Energy-saving circuitry for a rapid-start fluorescent lighting system includes a reactance-modifying capacitor coupled in series with first and second fluorescent lamps and includes a filament switch which is operative to conduct filament heating current during starting of the first lamp. The filament switch is coupled between filaments at opposite ends of the first fluorescent lamp and triggers to a low impedance state in response to the lamp starting voltage. A capacitor bypass switch can be coupled in parallel with the reactance-modifying capacitor to reduce the impedance of the series circuit during lamp starting.

7 Claims, 5 Drawing Figures

ENERGY SAVING FLUORESCENT LIGHTING SYSTEM

BACKGROUND OF THE INVENTION

This invention relates to circuitry for reducing the energy consumption of fluorescent lamps and more particularly to new and improved circuitry for reducing the energy consumption of a rapid-start two lamp fluorescent lighting system of the type which utilizes a sealed ballast unit.

The rapidly increasing cost of energy has stimulated an effort to reduce the energy consumption of lighting systems used in homes, office buildings, retail stores and the like. Furthermore, some electrical utilities have been requiring certain customers to either reduce electrical power consumption or be financially penalized.

One widely used type of lighting system is a rapid-start fluorescent lamp fixture wherein two elongated fluorescent lamps are connected in series and coupled to the output of a sealed ballast unit. The ballast unit provides appropriate voltages and currents to start and operate the series-connected fluorescent lamps. The design of the system is such as to provide full lamp brightness. Because the ballast unit is sealed, modification of already existing lighting systems for energy reduction is impractical. Furthermore, large numbers of two lamp fixtures are commonly wired to one ON-OFF switch. Thus, selective turning off of fluorescent lamps is impossible unles the system is rewired.

Various approaches have been taken to save energy in rapid-start fluorescent lighting systems. Alternate pairs of lamps can be removed from the lighting system. However, uneven illumination is provided and significant reactive current is drawn by the unloaded ballast unit. U.S. Pat. No. 3,956,665, issued May 11, 1976 to Westphal, discloses another method of reducing energy consumption. One of the two lamps in the two lamp rapid-start system is replaced with a so-called phantom tube. The phantom tube consists of a capacitor sealed within a glass or plastic tube and connected between opposite ends thereof. When the phantom tube replaces a lamp in a two lamp rapid-start system, it preserves the series circuit thus allowing the remaining lamp to light. One disadvantage is that the use of the phantom tube results in an uneven light distribution since the tube produces no light of its own.

A capacitor coupled in series with the two fluorescent lamps of the rapid-start system has been utilized to reduce energy consumption by increasing the capacitive reactance of the load on the ballast unit. U.S. Pat. No. 3,954,316, issued May 4, 1976 to Luchetta, discloses a circuit comprising a capacitor and an isolation transformer for reducing energy consumption in a fluorescent lamp system. However, the isolation transformer is a relatively large, heavy, and expensive component. When the transformer is packaged at one end of a fluorescent lamp in a housing with the impedance-modifying capacitor, an appreciable portion of the useful lamp length is lost, and the lamp is heavier at the transformer end. Also, the cost of the isolation transformer and its associated housing is relatively high. U.S. Pat. No. 4,146,820, issued Mar. 27, 1979 to Bessone et al, discloses a power reducer for a rapid-start fluorescent lamp wherein a relay switches a current reducing capacitor in series with the lamp after a predetermined time interval.

SUMMARY OF THE INVENTION

It is a general object of the present invention to provide new and improved energy-saving circuitry for use with fluorescent lighting systems.

It is another object of the present invention to provide energy-saving circuitry for fluorescent lamp systems wherein transformers external to the sealed ballast unit are not required.

It is yet another object of the present invention to provide energy-saving circuitry for fluorescent lighting systems wherein mechanical switching contacts are not required.

It is yet another object of the present invention to provide energy-saving circuitry for fluorescent lighting systems wherein the distribution of illumination is not substantially affected.

It is still another object of the present invention to provide energy-saving circuitry of relatively low size, cost and weight for fluorescent lighting systems.

According to the present invention, these and other objects and advantages are achieved in energy-saving circuitry for use in a rapid-start fluorescent lamp lighting system of the type including first and second fluorescent lamps, each having first and second filaments sealed therein at opposite ends, and a sealed ballast unit. The sealed ballast unit includes a high voltage output, a first low voltage output, and second and third low voltage outputs coupled to the filaments, respectively, of the second fluorescent lamp. The energy-saving circuitry includes a reactance-modifying capacitor coupled in a series circuit with the first and second fluorescent lamps across the high voltage output of the ballast unit. One lead of the first filament and one lead of the second filament of the first fluorescent lamp are coupled in the series circuit. The energy-saving circuitry further includes filament switching means including a first terminal coupled to the other lead of the first filament of the first lamp and a second terminal coupled to the other lead of the second filament of the first lamp. The filament switching means is operative to provide a low impedance path therethrough during starting of said first lamp and is operative to provide a high impedance path therethrough during normal operation of said first lamp. In a preferred embodiment, the filament switching means switches to a low impedance state when the voltage thereacross exceeds a predetermined threshold voltage. The filament switching means thus conducts filament heating current during lamp starting. The reactance-modifying capacitor increases the series capacitive reactance of the lighting system during normal operation, thereby reducing the energy consumption of the system.

The energy saving circuitry can further include capacitor bypass switching means including first and second terminals coupled electrically in parallel with the reactance-modifying capacitor. The capacitor bypass switching means is operative to provide a low impedance path therethrough during starting of the first lamp and is operative to provide a high impedance path therethrough during normal operation of the first lamp. In a preferred embodiment, the capacitor bypass switching means switches to a low impedance state when the voltage thereacross exceeds a second predetermined threshold voltage. The capacitor bypass switching means bypasses the reactance-modifying capacitor during lamp starting.

For a better understanding of the present invention, together with other and further objects, advantages, and capabilities thereof, reference is made to the following disclosure and appended claims in connection with the above-described drawings.

DESCRIPTION OF THE PREFERRED EMBODIMENTS

Figure 1:
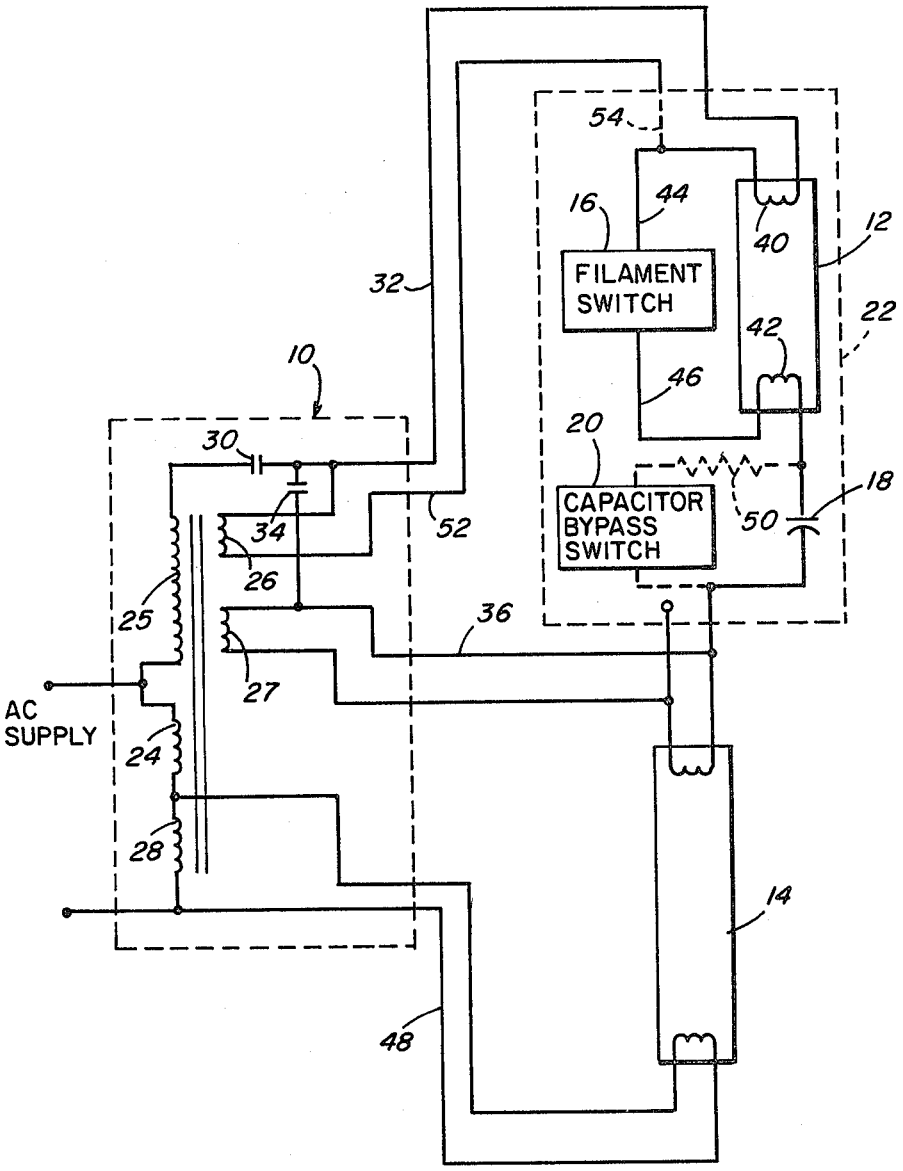
FIG. 1 is a schematic diagram of a preferred embodiment of the present invention.

A rapid-start fluorescent lighting system incorporating energy-saving circuitry according to the present invention is illustrated in FIG. 1. The lighting system includes a sealed ballast unit 10, a first fluorescent lamp 12, and a second fluorescent lamp 14 which are the standard components of a two lamp system. The energy-saving circuitry includes a filament switch 16 and a reactance-modifying capacitor 18 and can include a capacitor bypass switch 20. These added components are associated with the fluorescent lamp 12 and may be included within a packaged unit 22 that physically replaces a standard fluorescent lamp.

The ballast unit 10 includes a high reactance ballast transformer which includes a primary winding 24, a high voltage secondary winding 25 connected in autotransformer configuration, a first low voltage secondary winding 26, a second low voltage secondary winding 27, and a third low voltage secondary winding 28. The third low voltage secondary winding 28 is also connected in autotransformer configuration. The output of the high voltage secondary winding 25 is connected through a capacitor 30 to one lead 32 of the first low voltage secondary winding 26. A start capacitor 34 is coupled between the lead 32 of the winding 26 and one lead 36 of the second low voltage secondary winding 27.

The fluorescent lamps 12 and 14 have an elongated cylindrical shape and have filaments sealed therein at opposite ends. One example is a 40 watt T12 fluorescent lamp. The leads of the low voltage secondary windings 27 and 28 are coupled to the filaments, respectively, at opposite ends of the second fluorescent lamp 14. The lead 32 of the low voltage secondary winding 26 is coupled to one lead of a first filament 40 of the first fluorescent lamp 12. The reactance-modifying capacitor 18 is coupled between one lead of a second filament 42 of the first fluorescent lamp 12 and one of the filaments of the second fluorescent lamp 14. A filament switch 16 includes a terminal 44 coupled to the other lead of the first filament 40 and a terminal 46 coupled to the other lead of the second filament 42.

The filament switch 16 is a two-terminal, two-state device or circuit activated by the voltage appearing across the terminals 44 and 46. When the voltage appearing across the terminals is below a predetermined threshold voltage, the switch 16 provides a high impedance path therethrough. The switch 16 provides a low impedance path therethrough after a voltage applied between the terminals 44 and 46 exceeds the predetermined threshold voltage. Specific embodiments of the filament switch 16 will be discussed hereinafter.

When ac power is first applied to the lighting system of FIG. 1, both fluorescent lamps 12 and 14 are in a high impedance state and a high ac voltage generated by the secondary winding 25 is applied through the capacitors 30 and 34 to the second fluorescent lamp 14. Low voltage secondary windings 27 and 28 supply current to the filaments of the second fluorescent lamp 14 causing them to be heated. The hot filaments in combination with the high voltage applied across the lamp 14 causes formation of a discharge and a reduction in the impedance of the lamp 14. After the second lamp 14 has been started, most of the high voltage output of the ballast unit 10 appears across the series combination of the first fluorescent lamp 12 and the reactance-modifying capacitor 18. The high alternating voltage appearing across the first lamp 12 causes triggering of the switch 16 to its low impedance state at those times during each cycle when its magnitude exceeds some predetermined threshold voltage. The switch 16 can be unipolar in its operation in which case the switch 16 has a positive threshold voltage and can be triggered only on one of the half cycles of the input power. Alternatively, the switch 16 can be bipolar in its operation, in which case the switch 16 has both positive and negative threshold voltages and can be triggered on both half cycles of the input power. For the remainder of the half cycle after triggering of the switch 16, current is conducted through the first filament 40, the filament switch 16, the second filament 42 and the capacitor 18 causing heating of the filaments 40 and 42. This heating is cumulative with successive cycles of the input power and results in a lowering of the breakdown voltage of the lamp 12 until the latter falls below the threshold voltage of the switch 16. At this point, the lamp 12 starts and conducts on each half cycle of the power line thereby preventing further conduction of the switch 16. After formation of a discharge in the first lamp 12, heating of the filaments 40 and 42 is provided by the electrode losses of the discharge itself. Thus, it can be seen the predetermined threshold voltage of the switch 16 is in the range between the voltage applied to the lamp 12 during starting and the normal, fully warmed-up operating voltage of the lamp 12.

The reactance-modifying capacitor 18 is coupled in a series circuit with the first fluorescent lamp 12 and the second fluorescent lamp 14 across the high voltage output of the ballast unit 10 which appears between the lead 32 of the low voltage secondary winding 26 and a lead 48 of the low voltage secondary winding 28. The capacitor 18 is effectively in series with the capacitor 30, thereby causing a reduction in the overall series capacitance and a corresponding increase in capacitive reactance. The voltage appearing across the capacitor 18 reduces the voltage available to the lamps 12 and 14. Furthermore, the impedance added by the capacitor 18 reduces the current flow through the series combination of the lamps 12 and 14 and the capacitor 18. Hence, the power input and the light output of the fluorescent lamps 12 and 14 is reduced. Typically, in a circuit with two 40 watt F40T12 lamps, a four microfarad capacitor reduces power consumption by 33% while a two microfarad capacitor reduces power consumption by 50%.

When small values of the reactance-modifying capacitor 18 are utilized, the higher impedance associated with small values of capacitance causes a reduction in current through the filaments 40 and 42 and the filament switch 16 during starting of the lamp 12. For some values of the capacitor 18, the current through the filaments 40 and 42 is insufficient to cause starting of the lamp 12. To resolve this problem, a capacitor bypass switch 20 is coupled electrically in parallel with the reactance-modifying capacitor 18. The capacitor bypass switch 20 is a two terminal, two state device or circuit which provides a high impedance path therethrough when the voltage thereacross is below a predetermined voltage. The switch 20 provides a low impedance path therethrough after a voltage, applied between the terminals, exceeds a predetermined threshold voltage. The switch 20, in effect, bypasses the reactance-modifying capacitor 18 during the starting of the fluorescent lamp 12.

As described hereinabove, during starting of the fluorescent lamp 12, a high voltage generated by the ballast unit 10 is applied to the lamp 12 triggering the switch 16 to its low impedance state. The increased current flowing through the lamp filaments 40 and 42 via conducting switch 16 causes a rapid charging of the capacitor 18 to a second triggering point during the same half cycle of the input power at which time the voltage across the switch 20 causes it to be triggered into its low impedance state thereby further increasing the current for the remaining half cycle. Thus, a relatively high current flows through filaments 40 and 42 causing the fluorescent lamp 12 to be started in a few seconds. After a discharge is formed in the fluorescent lamp 12, the filament switch 16 remains in its high impedance state as described hereinabove and the peak voltage reached by the capacitor 18 is reduced. The reduced voltage across the capacitor 18, in turn, causes the capacitor bypass switch 20 to remain in its high impedance state. Thus, the filament switch 16 and the capacitor bypass switch 20 are both in a high impedance state during normal fully warmed-up operation of the fluorescent lamps 12 and 14. An optional current-limiting resistor 50 can be connected in series with the capacitor bypass switch 20 to limit the surge current from the capacitor 18 when the capacitor bypass switch 20 triggers to its low impedance state.

When a second lead 52 of the low voltage secondary winding 26 is not connected to the fluorescent lamp 12, heating current is provided to the filaments 40 and 42 only during starting of the fluorescent lamp 12 as described hereinabove. Alternatively, the second lead 52 of the low voltage secondary winding 26 can be connected to the junction point of the filament 40 and the filament switch 16 as shown by a dotted lead 54 in FIG. 1. In this configuration, the low voltage secondary winding 26 provides heating current to the filament 40 continuously after power is applied to the system so that the fluorescent lamp 12 will conduct readily when the alternating voltage polarity is such that the filament 40 is negative with respect to the filament 42. In this configuration, the switch 16 need only be unipolar in its switching characteristic so that it is triggered into its low impedance state when the voltage at the terminal 44 attached to the filament 40 is positive and the voltage at the terminal 46 attached to the filament 42 is negative. This configuration provides quicker and more reliable starting of the fluorescent lamp 12.

As discussed hereinabove, the predetermined threshold voltage of the filament switch 16 is between the normal operating voltage of the fluorescent lamp 12 and the higher voltage applied to the lamp 12 by the ballast unit 10 during starting. For a standard 40 watt T-12 fluorescent lamp, the operating voltage is approximately 200 volts peak and the minimum ballast voltage during starting is approximately 455 volts peak. In one example of the filament switch 16, the threshold voltage is 400 volts. The predetermined threshold voltage of the capacitor bypass switch 20 is between the voltage appearing across the capacitor 18 during normal operation of lamp 12 and the higher voltage appearing across the capacitor 18 during starting of the lamp 12. When a two microfarad capacitor is utilized in conjunction with a 40 watt T-12 fluorescent lamp, the voltage across the capacitor 18 during normal operation is approximately 200 volts peak and the voltage across the capacitor 18 during starting is approximately 455 volts peak. In one example of the capacitor bypass switch 20, the threshold voltage is 225 volts.

Figure 2:
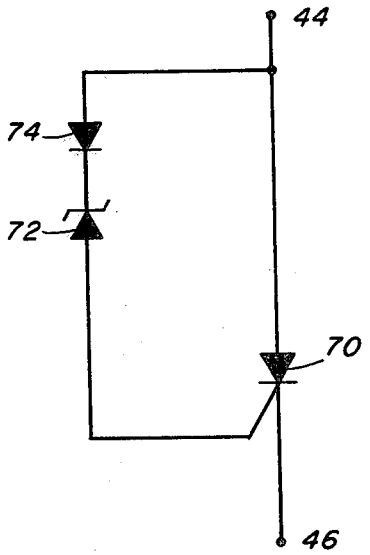
FIGS. 2 to 5 are schematic diagrams of specific embodiments of the filament switch and the capacitor bypass switch shown in block diagram form in FIG. 1.

Specific examples of the filament switch 16 and the capacitor bypass switch 20 are illustrated in FIGS. 2–5. Although the terminal designations 44 and 46 of the filament switch 16 are shown in FIGS. 2–5, it is to be understood that the devices and circuits illustrated in FIG. 2–5 can also be utilized for the capacitor bypass switch 20. In FIG. 2, a silicon controlled rectifier (SCR) 70 provides the switching action. The anode of the SCR 70 is coupled to the terminal 44 and the cathode of the SCR 70 is coupled to the terminal 46 of the switch. A series combination of a zener diode 72 and a rectifier diode 74 is coupled between a gate terminal of the SCR 70 and the anode terminal of the SCR 70 so as to provide turn-on current to the gate of the SCR 70 when the voltage between the terminals 44 and 46 of the switch exceeds the breakdown voltage of the zener diode 72. The zener diode 72 and the rectifier diode 74 are connected so that the diode 74 protects the SCR 70 and the zener diode 72 during negative half cycles of the ac voltage. The SCR 70 triggers to its 37 on" state when the terminal 44 exceeds a predetermined positive voltage and remains in its low impedance state until the end of the half cycle. It does not trigger "on" with the polarity reversed and therefore is a unipolar switch preferably used when the optional connection 54, shown in FIG. 1 and discussed hereinabove, is used.

Figure 3:
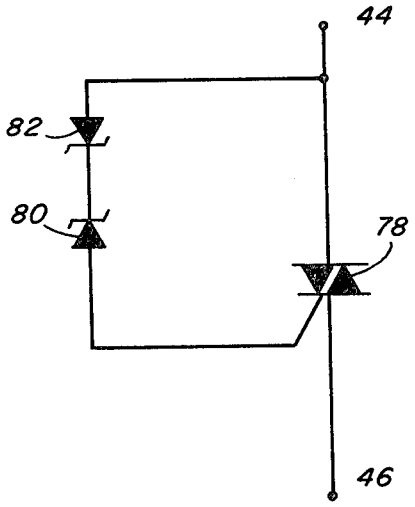

In the switch circuit illustrated in FIG. 3, a triac 78, having its main terminals coupled between the external terminals 44 and 46 of the switch, provides the switching action. A pair of zener diodes 80 and 82, coupled in series with opposite polarities and coupled between a gate terminal of the triac 78 and the appropriate main terminal of the triac 78, determines the threshold switching voltage of the triac 78. When the voltage applied between the terminals 44 and 46 exceeds one of zener diode voltages, turn-on current is provided to the triac 78. The circuit illustrated in FIG. 3, in contrast to the circuit of FIG. 2, provides switching action on both half cycles of the ac voltage. The triac 78 conducts between the time when the ac voltage exceeds the predetermined threshold voltage and the time when the ac current reverses polarity.

Figure 4:
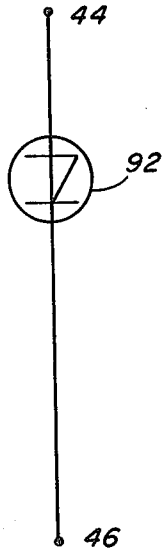

The switch 92 illustrated in FIG. 4 in symbolic form is a voltage triggered unilateral switch known as a four layer diode. Its construction is similar to that of an SCR but it has no gate terminal. Its triggering current flows internally at the zener breakdown voltage of its internal junctions when the terminal 44 exceeds a predetermined positive voltage relative to the terminal 46. The switch 92 is a unipolar switch electrically equivalent to the circuit shown in FIG. 2.

Figure 5:
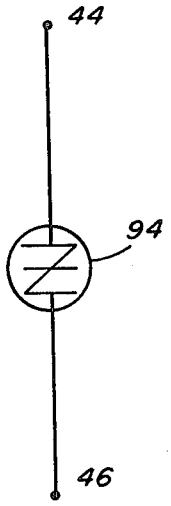

The switch 94 illustrated in FIG. 5 in symbolic form is a voltage triggered bilateral switch which is a self-contained semiconductor device which switches from a high impedance state to a low impedance state after the voltage thereacross exceeds a predetermined threshold value. It is electrically equivalent to the circuit shown in FIG. 3. Examples of such devices are the SIDAC supplied by Teccor Electronics, Inc. of Dallas, Texas, and the model K IV SIDAC supplied by Shindengen Electric Manufacturing Company, Limited of Tokyo, Japan.

In another approach the switch 20 consists of a positive temperature coefficient (PTC) resistive element that switches abruptly from an initial low impedance state to a high impedance state at a predetermined temperature, reached preferably after starting has been completed. It remains in the high impedance state above its transition temperature because the voltage drop across the capacitor 18 during lamp operation causes a sufficient power dissipation in the PTC element to maintain its elevated temperture. This capacitor bypass element is limited in effectiveness when the lamp does not start before the PTC element switches, and also when the lamp must restart after a momentary off period.

The energy-saving circuitry of the present invention, which includes the switch 16 and the reactance-modifying capacitor 18 and can include the switch 20 and the resistor 50, can be packaged with the fluorescent lamp 12 to provide the energy-saving fluorescent lamp assembly 22 as shown and described in U.S. Pat. No. 4,163,176, issued July 31, 1979, to Cohen et al. The energy-saving circuitry is packaged in an appropriate cylindrical housing at one end of a shortened fluorescent lamp. The overall length of the assembly 20, including the housing and the shortened fluorescent lamp, is equal to the overall length of standard fluorescent lamps. Therefore, the energy-saving lamp assembly can be utilized in existing fluorescent lamp fixtures.

While there has been shown and described what is at present considered the preferred embodiments of the invention, it will be obvious to those skilled in the art that various changes and modifications may be made therein without departing from the scope of the invention as defined by the appended claims.

We claim:

1. In a rapid-start fluorescent lamp lighting system of the type including first and second fluorescent lamps, each having first and second filaments sealed therein at opposite ends, and a sealed ballast unit including a high voltage output, a first low voltage output, and further including second and third low voltage outputs coupled to said filaments, respectively, of said second fluorescent lamp, energy-saving circuitry comprising:

a reactance-modifying capacitor coupled in a series circuit with said first and second fluorescent lamps across said high voltage output of said ballast unit, said first fluorescent lamp having one lead of said first filament and one lead of said second filament coupled in said series circuit;

filament switching means, including a first terminal coupled to the other lead of said first filament of said first lamp and a second terminal coupled to the other lead of said second filament of said first lamp, operative to provide a low impedance path therethrough during starting of said first lamp and operative to provide a high impedance path therethrough during normal operation of said first lamp; and voltage responsive capacitor bypass switching means, including first and second terminals coupled electrically in parallel with said reactance-modifying capacitor, operative to provide a low impedance path therethrough part of ac cycles during starting of said first lamp and operative to provide a high impedance path therethrough during normal operation of said first lamp, said capacitor bypass switching means including means for providing said low impedance path therethrough after voltage across said terminals of said capacitor bypass switching means, exceeds a predetermined voltage, said predetermined voltage being greater than the voltage across said reactance-modifying capacitor during normal operation of said first fluorescent lamp and being less than the voltage across said reactance-modifying capacitor during starting of said first fluorescent lamp.

whereby said filament switching means is operative to conduct filament heating current during lamp starting, whereby said capacitor bypass switching means is operative to bypass said reactance-modifying capacitor during part of ac cycles during lamp starting facilitating starting, and whereby said reactance-modifying capacitor increases the series capacitive reactance of said lighting system during normal operation, thereby reducing the energy consumption of said system.

2. Energy-saving circuitry as defined in claim 1 wherein said voltage response capacitor bypass switching means includes a silicon controlled rectifier switching element having an anode coupled to said first terminal of said capacitor bypass switching means and a cathode coupled to said second terminal of said capacitor bypass switching means and further includes means, coupled to a gate terminal of said silicon controlled rectifier, for supplying turn-on current thereto when the voltage between said first terminal and said second terminal of said capacitor bypass switching means exceeds said predetermined voltage.

3. Energy-saving circuitry as defined in claim 1 wherein said capacitor bypass switching means includes a triac coupled between said first terminal and said second terminal of said capacitor bypass switching means and further includes means, coupled to a gate terminal of said triac, for supplying turn-on current thereto when the voltage between said first terminal and said second terminal of said capacitor bypass switching means exceeds said predetermined voltage.

4. Energy-saving circuitry as defined in claim 3 wherein said means for supplying turn-on current to said triac includes zener diodes coupled in series and with opposite polarities between said gate terminal and one of said terminals of said capacitor bypass switching means.

5. Energy-saving circuitry as defined in claim 1 wherein said capacitor bypass switching means includes a voltage triggered bilateral switch coupled between said first and second terminals of said capacitor bypass switching means.

6. Energy-saving circuitry as defined in claims 1, 2, 3, 4, or 5 further including a current-limiting resistor coupled in series with said capacitor bypass switching means.

7. Energy-saving circuitry as defined in claims 1, 2, 3, 4 or 5 wherein said first low voltage output is coupled to said first filament of said first fluorescent lamp.

* * * * *